United States Patent [19]

Focke et al.

[11] 4,003,467

[45] Jan. 18, 1977

[54] PACK CONSISTING OF A FOLDABLE BLANK, MORE PARTICULARLY A CIGARETTE PACK AND A DEVICE FOR CLOSING THE SAME

[75] Inventors: Heinz Focke; Kurt Liedtke, both of Verden, Aller, Germany

[73] Assignee: Focke & Pfuhl, Verden, Aller, Germany

[22] Filed: Feb. 19, 1975

[21] Appl. No.: 551,451

[30] Foreign Application Priority Data

Feb. 19, 1974 Germany ..... 2407766

[52] U.S. Cl. ..... 206/273; 206/245; 206/264; 206/274; 229/37 R; 229/58; 229/87 C

[51] Int. Cl.[2] ..... B65D 85/10

[58] Field of Search ..... 206/245, 271, 273, 274; 229/87 C, 37, 40, 39, 55, 57, 58, 51 C

[56] References Cited

UNITED STATES PATENTS

| | | | |
|---|---|---|---|
| 426,607 | 4/1890 | Single | 229/58 |
| 681,323 | 8/1901 | Houghland | 229/40 |
| 1,215,464 | 2/1917 | Armstrong | 206/274 |
| 1,702,325 | 8/1966 | Van Sickels | 206/274 |
| 3,265,287 | 8/1966 | Hovland | 206/274 |
| 3,276,668 | 10/1966 | Tamarin | 229/87 C |
| 3,333,683 | 8/1967 | Scharre | 229/87 C |
| 3,362,614 | 1/1968 | Farauhar | 229/37 R |
| 3,366,304 | 1/1968 | Peckar et al. | 229/37 R |
| 3,581,978 | 6/1971 | Kappelhoff et al. | 229/55 |
| 3,591,072 | 7/1971 | Sannino | 229/55 |
| 3,776,451 | 12/1973 | Goodrich et al. | 229/55 |

*Primary Examiner*—William Price
*Assistant Examiner*—Bruce H. Bernstein
*Attorney, Agent, or Firm*—Sughrue, Rothwell, Mion, Zinn & Macpeak

[57] ABSTRACT

There is disclosed a technique for forming a pack from a foldable blank consisting of a compound foil for receiving rod-shaped articles, typically cigarettes. The blank encloses the contents of the pack in a tubular manner, and the front ends overlapping at least partially interconnected flaps are folded in such a way that an inner longitudinal end flap rests against the contents of the pack. Two side end flaps are folded on these longitudinal end flaps, and the second outer longitudinal end flaps are folded on the side end flaps and the first inner longitudinal end flaps. The sides of the longitudinal end flaps facing toward each other and the edge region of the inwardly folded side end flaps are connected together in a sealed manner by means of a straight bonded or adhesive strip which extends over the width of the pack in the half portion of the front face facing toward the outer longitudinal end flap.

18 Claims, 18 Drawing Figures

Fig.1
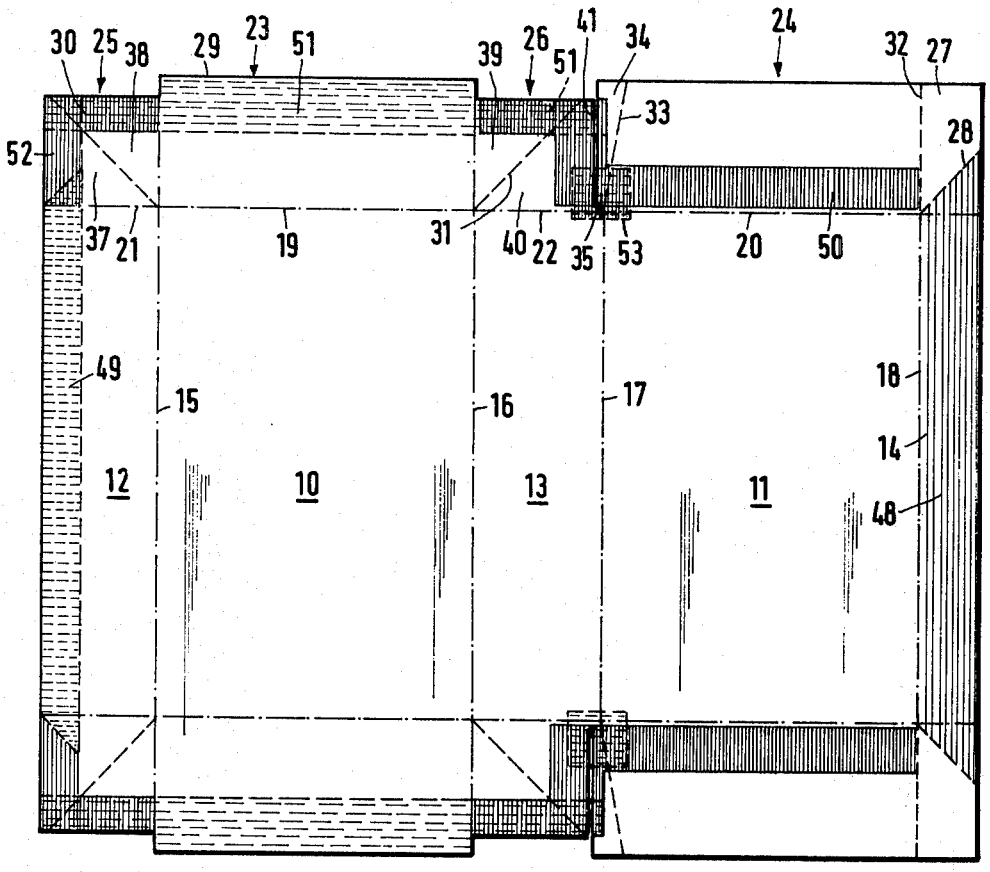
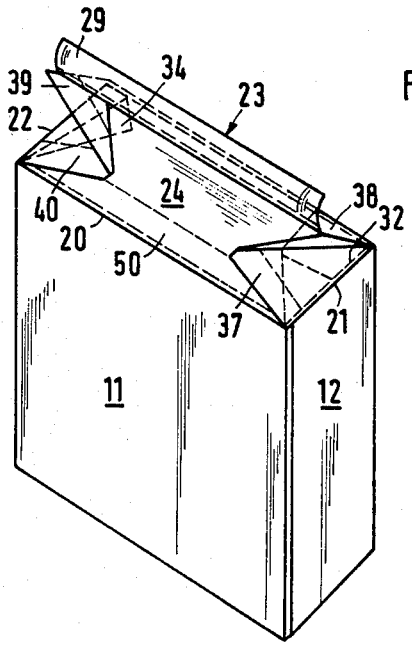
Fig.2

PACK CONSISTING OF A FOLDABLE BLANK, MORE PARTICULARLY A CIGARETTE PACK AND A DEVICE FOR CLOSING THE SAME

BACKGROUND OF THE INVENTION

1. Field of the Invention

The present invention relates to a pack consisting of a foldable blank, more particularly, a compound foil, for receiving rod-shaped articles, preferably cigarettes. The blank encloses the contents of the pack in a tubular manner and at the front ends, overlapping, at least partially interconnected flaps are folded in such a way that an inner longitudinal end flap rests against the contents of the pack, two side end flaps are folded on these longitudinal end flaps and the second outer longitudinal end flaps are folded on the side end flaps and the first inner longitudinal end flaps.

2. Description of the Prior Art

Compound foils are essentially already known as packaging material. They consist of a plurality of interconnected layers. One embodiment of such a foil consists of five layers: three polyethylene foil layers, an aluminum layer and a paper layer. The layers are always arranged with a polyethylene foil layer on the outside. This is followed by the paper layer or the aluminum layer. These two layers are separated from each other by an inner polyethylene foil layer.

SUMMARY OF THE INVENTION

The object of the present invention is to produce a pack of the simplest construction in which compound foils can be used and which enables a seal-tight closure to be mechanically produced on the front sides at a low cost.

The pack according to the invention which is designed to solve this problem is characterized in that the sides of the longitudinal end flaps facing towards each other and the edge region of the inwardly folded side end flaps are connected together in a sealed manner by means of a straight bonded or adhesive strip extending over the width of the pack in the half of the front face of the pack facing towards the outer longitudinal end flap.

Other objects, features and advantages of the present invention will be made apparent from the following detailed description of various embodiments of the pack according to the invention and of the devices for producing the pack closure; this description being provided with reference to the accompanying drawings.

BRIEF DESCRIPTION OF THE DRAWINGS

FIG. 1 shows a blank for producing a pack from a compound foil. The blank is shown in the flattened state with the outer side facing upwards.

FIG. 2 is a perspective view of a pack produced from the blank shown in FIG. 1. This blank has been completed except for the closure on the front side.

DESCRIPTION OF THE PREFERRED EMBODIMENTS

Figure 3:
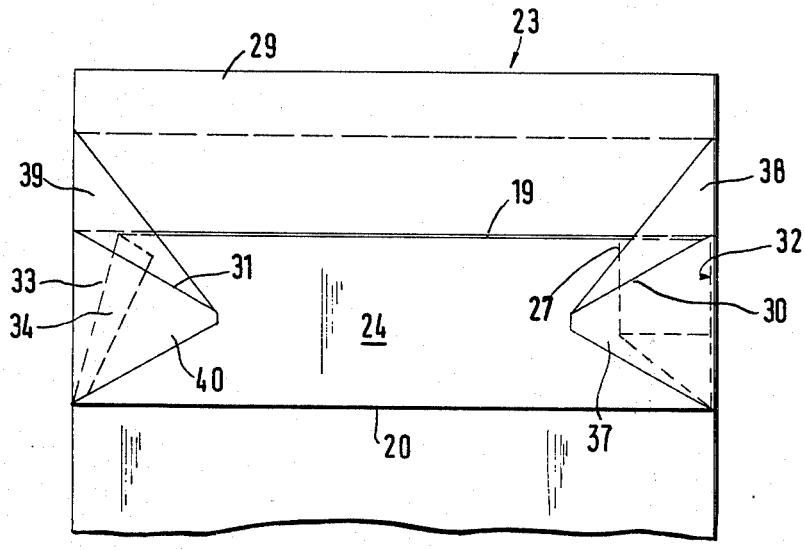
FIG. 3 is an oblique view from above on a larger scale than FIGS. 1 and 2 of the front side closure of the otherwise completed pack during one stage of production of the front side closure.

The invention relates to packs having an angular cross-section, more particularly, to parallelipipedic packs for cigarettes, etc.

FIG. 1 showns a flattened blank consisting of a compound foil. Individual regions which form the front wall 10, the rear wall 11 and the side walls 12 and 13 of the finished pack are defined by the broken lines. The broken lines represent the four longitudinal edges 15, 16, 17 and 18 of the pack and the transversely directed lines define the lateral long edges 19 and 20 and the lateral short edges 21 and 22.

Front and back end flaps 23 and 24 are attached to the front wall 10 and the rear wall 11. The side end flaps 25 and 26 are produced in the region of the side walls 12 and 13. The above-mentioned end flaps 23 - 26 are defined in respect of the rear and side walls by the front edges 19–22.

The end flaps 23 – 26 are connected together at least partially. A side strip 14 which is extended in the region of the back endflap 24 by an end strip 27 which is, in turn, connected to the longitudinal end flap 24, is laterally attached to the rear wall 11.

When a pack is produced from the blank shown in FIG. 1, a tubular intermediate structure is first formed by connecting one lateral end region of the side wall 12 to the side strip 14. In the region of the end strip 27 and of the side end flap 25, the connection of these parts only extends as far as a diagonal fold line 28 formed in the end strip 27 approximately at an angle of 45°.

The lateral free edges of the side end flaps 25 and 26 are offset with respect to the adjacent lateral free edges of the front and back end flaps 23 and 24. The front end flap 23, which is disposed on the outside in the finished pack, has a connecting strip 29 thereon which is connectable with the outer side of the back end flap 24 and which overlaps the folded side end flaps 25,26.

The end flaps are also provided with special pre-stamped or punched fold lines facilitating the operation of the folding of these end flaps inwards, which will be described in detail hereinafter. These fold lines are produced in a compound foil, preferably by weakening the inner layers. More particularly, the aluminum foil and the paper layer are weakened by means of perforations or punch holes and by leaving the outer polyethylene foil layers completely closed, thus ensuring that the blank is seal-tight in this region. Fold lines 30 and 31 which have each been produced in this way are provided in the region of each of the side end flaps 25 and 26 respectively. These fold lines start at the corner belonging to the front wall 10 of the pack and continue in the direction of the free corner of the side end flaps 25 or 26, ending with a lateral offset with respect to the corner. The afore-mentioned diagonal fold line 28 is also pre-stamped in this way. The extension of the back end 18 between the longitudinal edge flap 24 and the end strip 27 is also produced in the form of the marked pre-stamped back fold line 32. Lastly, the longitudinal end flap 24 is provided, in the region adjacent to the side end flap 26, with an auxiliary fold line 33 of identical construction. The latter defines a section 34 of the back end flap 24 with respect to a dividing cut 41 provided in this region between the back end flap 24 and the side end flap 26. This dividing cut 41 extends, with lateral displacement with respect to the longitudinal edge 17, as far as the proximity of the short front edge 22 but ends before reaching the same such that a corner connection 35 remains between the longitudinal end flap 24 and the side end flap 26. As is particularly apparent from FIGS. 4-6, this ensures that a sealed corner is also provided between the lateral edges 20 and 22.

The object of this type of pack construction is that of connecting together the engageable layers of the blank for forming a sealed pack closure by means of a common, straight, bonded or adhesive strip 36 extending over part of the front face of the pack. This is achieved by folding the side end flaps 25 and 26, in relation to an assumed longitudinal center plane of the front face, unsymmetrically against the inwardly folded back end flap 24 in such a way that all free and, accordingly, closable edges of the side end flaps 26 and 25 extend into the region facing towards the lateral long edge 20 with a staggered arrangement with respect to each other and with respect to the lateral long edge 20.

In the embodiment according to FIGS. 1 – 6, the back end flap 24 is first folded against the contents of the pack. In the course thereof, the corner connection 35 is simultaneously formed on the one side by folding the section 34 about the auxiliary fold line 33. On the opposite side, at this stage, the end strip 27 is folded in the region of the longitudinal fold line 32 into an upright position in respect of the back end flap 24. The end strip 27 is also folded about the diagonal fold line 28 while the part of this end strip 27 which is connected to the side end flap 25 first remains in the starting position of the tube folding operation.

The two side end flaps 25 and 26 are then folded simultaneously inwards in such a way that interconnected, triangular or approximately triangular gussets 37 and 38 or 39 and 40 are produced in the region of the fold lines 30 and 31. Each gusset, as shown best in FIG. 2, when folded inwardly along line 22, contains a free edge defined along that portion of line 16 on the gusset which will lie generally parallel to line 22 and a corresponding perpendicular free edge 42 which forms a component of a series of displaced folded edges. In the folded state these gussets are disposed on top of one another although, on account of the displacement of the dividing cut 41 and the displacement of the fold lines 30 and 31 relative to the corners of the side end flaps 25 and 26, a stagger arrangement of the free edges is produced. Thus, an edge 42 or 43 formed by a gusset 37 or 40 which is inwardly disposed in the folded state, is offset with respect to the lateral long edge 20. An opposite edge 44 or 45 of the gusset 38 or 39 is offset with respect to the edge 42 or 43 by approximately the same amount. The free edges 42 and 43 and 44 and 45, which are thus formed, are covered when the end of the pack is closed by the connecting strip 29 on the front end flap 23 and are connected to the same. The connecting strip 29 is also connected to the back end flap 24 over the entire length of the lateral long edge 20.

Figure 4:
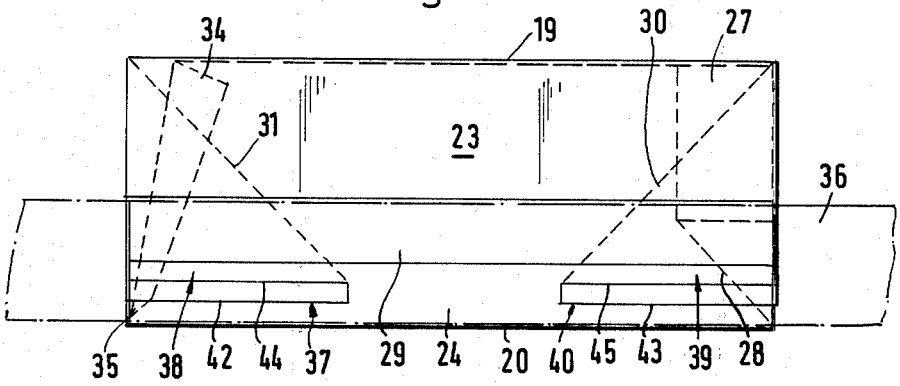
FIG. 4 is a plan view of the front side of the pack before the closure is completed.
Figure 5:
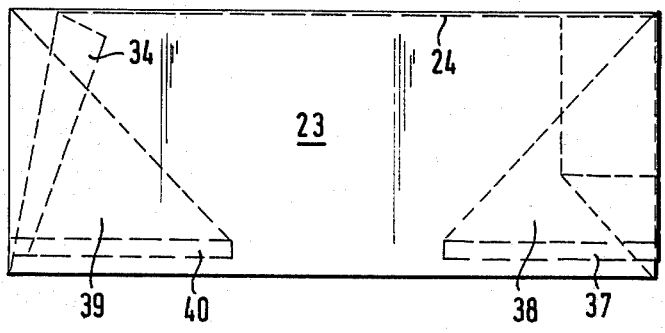
FIG. 5 is a view as shown in FIG. 4, but with the pack closed.
Figure 6:
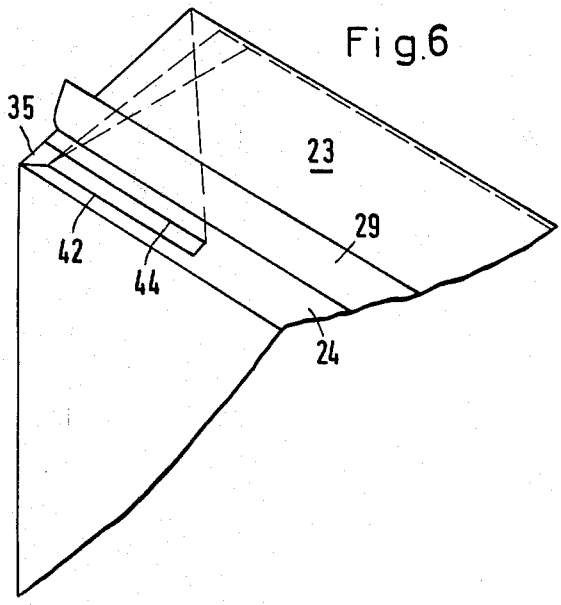
FIG. 6 is a perspective view of a corner section of the pack with the front side closure in the position shown in FIG. 4.
Figure 16:
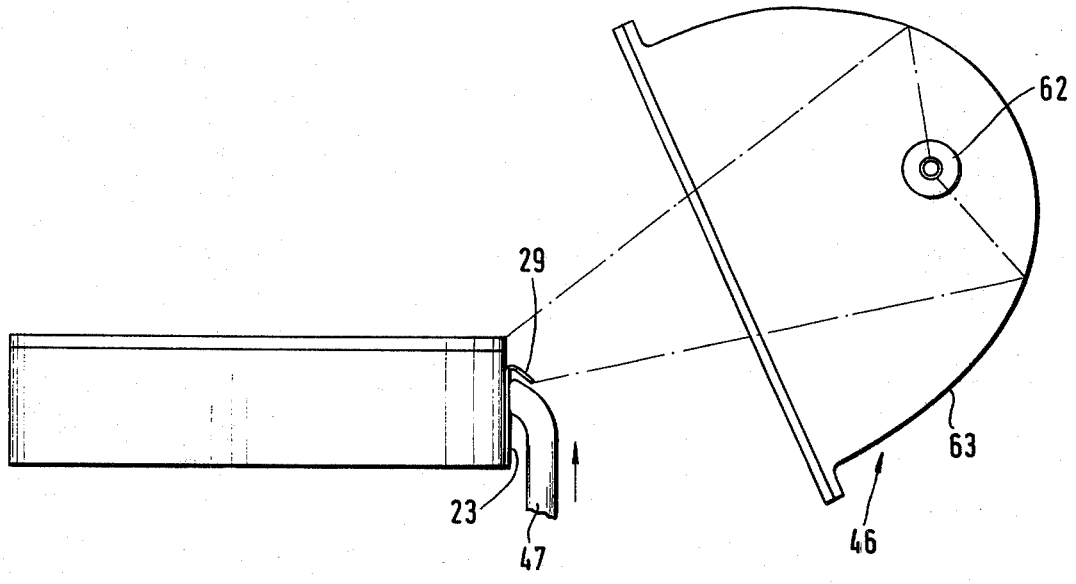
FIG. 16 is a side view of a pack during production of the closure with a device according to the invention for activating surface regions to be treated with heat.

The closure is produced in the manner indicated in FIGS. 4, 6 and 16. After the individual end flaps have been folded one on the other, the free connecting strip 29 on the front end flap 23 is bent back about an obtuse angle from the front face such that the underside is rendered outwardly free. This region corresponds generally to the width of the layers to be overlapped. An area of the end corresponding to the bonded or adhesive strip according to FIG. 4 is now activated, in the case of compound foils, preferably by an infra-red emitter 46. In the course thereof, both the outwardly disposed underside of the front end flap 23 and also the upwardly directed faces of the edges 42- 45 and the inner longitudinal end flap are activated. If the activation of the faces to be bonded together is effected with the closure in a semi-open position as shown in FIG. 2, the outer sides of the superposed gussets 37 and 38 or 39 and 40 can also be activated in the region of the bonded or adhesive strip such that the latter are also connected together when the pack is closed.

After activation, the connecting strip 29 is pressed over the layers, which have also been activated, by means of a die 47.

When a compound foil with thermally bondable outer layers is used, this foil is provided with dark, impressed bonding marks in the region of the bonding operation. In the embodiment according to FIG. 1, the side strip has a continuous bonding mark 48 on its upper side. On the under side, in the region of the side wall 12, is a corresponding mark 49. This bonding mark 48 extends as far as the region of the end strip 27, namely as far as the diagonal fold line 28.

The back end flap 24 is provided on its outer side with a bonding mark 50 extending along the front edge 20. This mark 50 is joined to the counter mark 51 disposed on the under side, in the region of the connecting strip 29 of the front longitudinal end flap 23. The side end flaps 25 and 26 have angular bonding marks 51 and 52 on their free edges. One arm of the bonding mark 51 extends into the region of the longitudinal end flap 24. The side end flaps 25 and 26 also have inner counter marks (shaded) on the free edges spaced apart from the front edges. A counter mark 53 is also provided in the region of the corner connection 35.

In the embodiment according to FIGS. 7 - 12, the end flaps are continuously connected together. A generally triangular flap 56 is defined in the region of the back end flap 24 and the adjoining side end flap 26 by the fold lines 54 and 55 which are disposed at an acute angle with respect to each other. When the closure is completed, this flap 56 is folded against the upper side of the inner longitudinal end flap 24.

Figure 7:
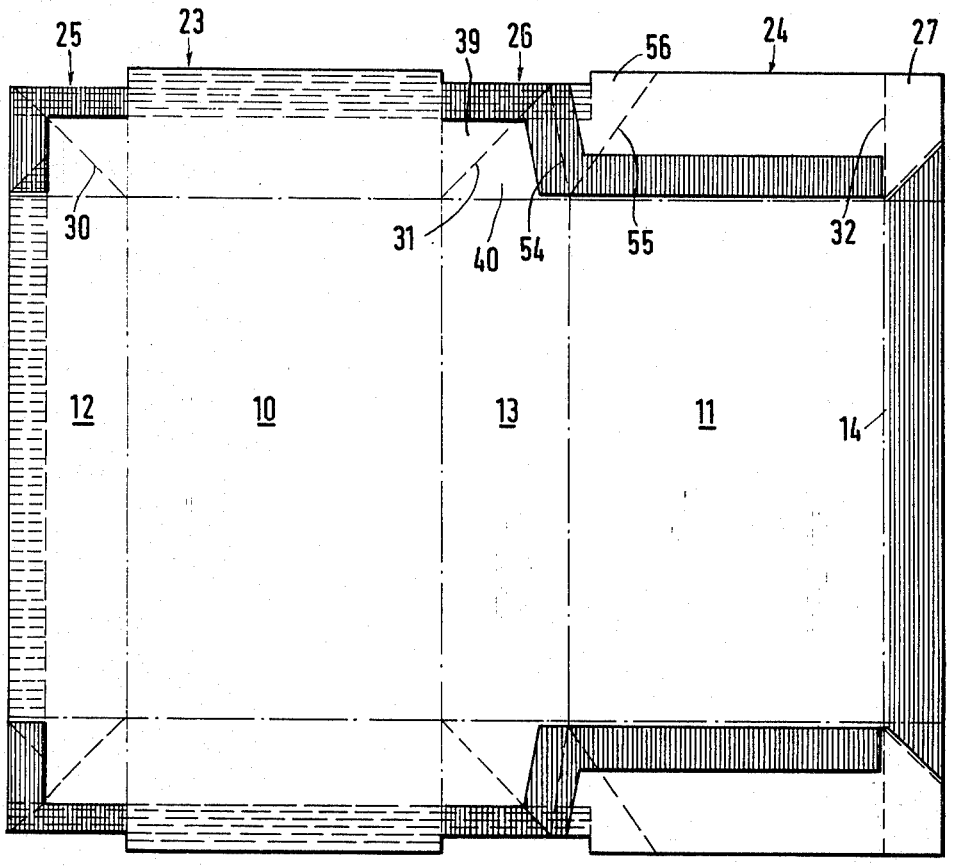
FIG. 7 is a blank of another embodiment of the pack shown as in FIG. 1.
Figure 8:
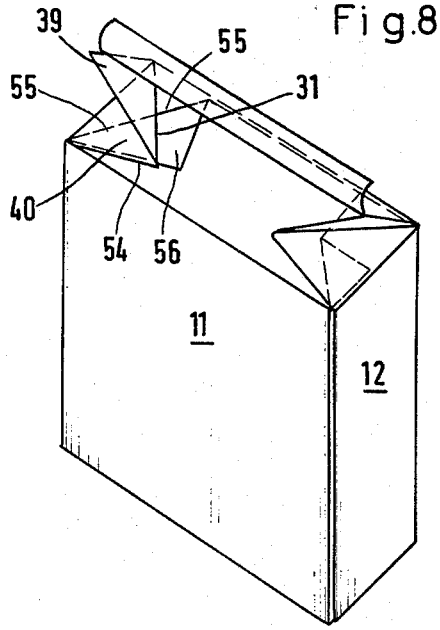
FIG. 8 is a perspective view according to FIG. 2 of the embodiment shown in FIG. 7.
Figure 9:
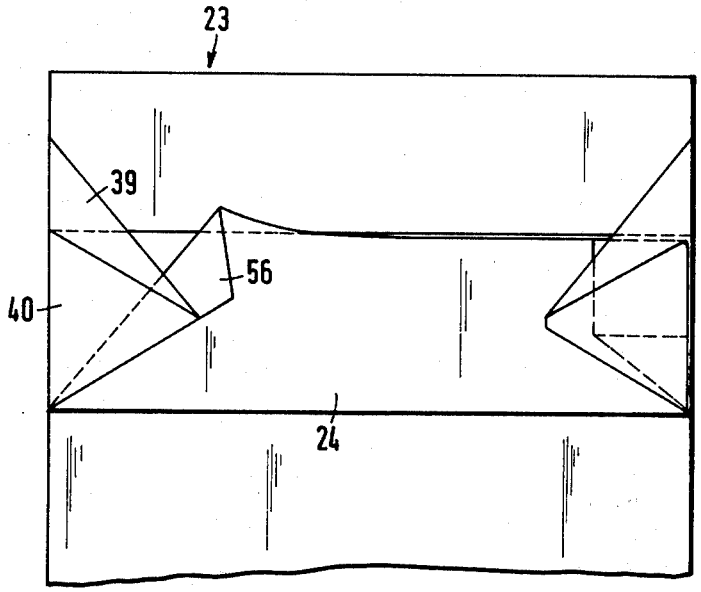
FIG. 9 is a view according to FIG. 3 of the embodiment shown in FIG. 7.
Figure 10:
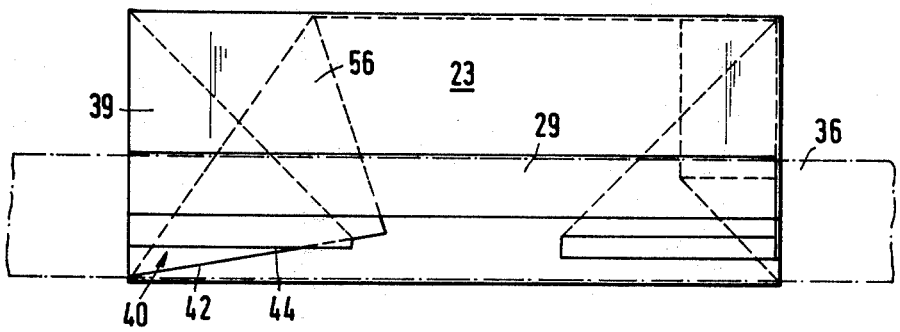
FIG. 10 is a view according to FIG. 4 of the embodiment shown in FIG. 7.
Figure 11:
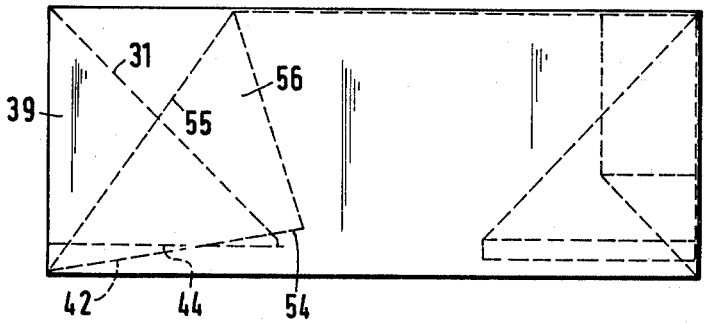
FIG. 11 is a view according to FIG. 5 of the embodiment shown in FIG. 7.
Figure 12:
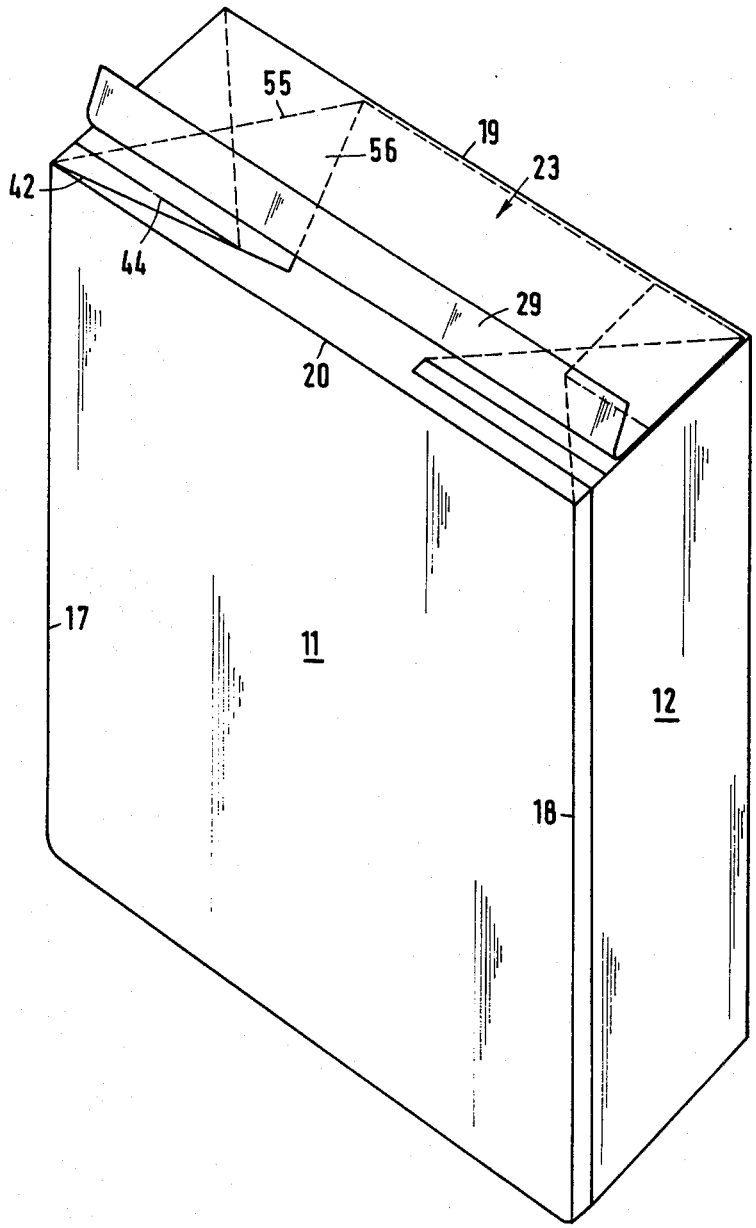
FIG. 12 is a perspective view according to FIG. 6 in the case of the embodiment according to FIG. 7.

Owing to the continuous connection of the end flaps, the corners of the pack are absolutely seal-tight. The gussets 39 and 40 of the side end flap 26 extend in this case as far as the corner of the pack. The edge 42 of the inner gusset 40 is not parallel to the front edge 20, but wedge-shaped. In principle, the closure is produced in the same manner as in the preceding embodiment. The only difference is the first folding stage in which the parts of the side end flaps 26 with the flaps 56 are folded at the same time as the back end flap 24 (FIG. 8). The arrangement of the bonding marks and the counter bonding marks in the blank shown in FIG. 7 is, in principle, comparable with the arrangement according to FIG. 1.

Figure 13:
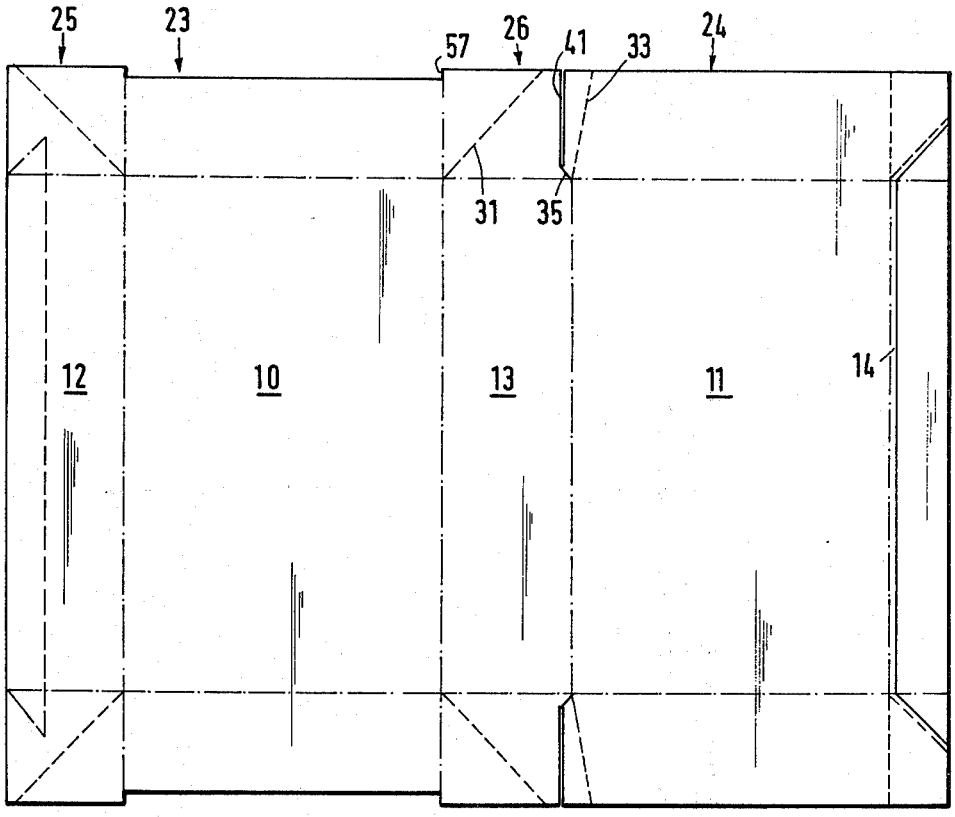
FIG. 13 is a view according to FIGS. 1 and 7 of the blank for another embodiment of the pack.
Figure 14:
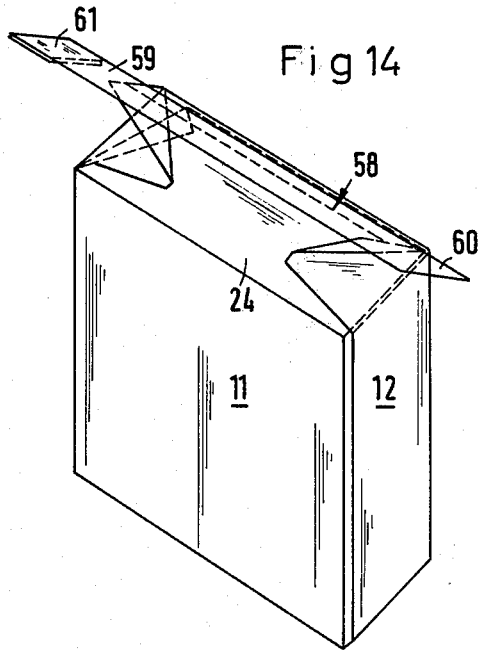
FIG. 14 is a perspective view according to FIGS. 2 and 8 of the embodiment according to FIG. 13.
Figure 15:
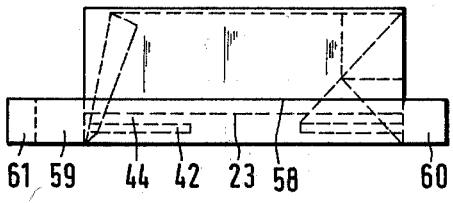
FIG. 15 is a plan view of the front side of the pack as shown in FIGS. 13 and 14.

In the embodiment according to FIGS. 13- 15, the folds of the closure corresponds largely to the embodiment shown in FIGS. 1 – 6. The main difference is that the free edge of the front end flap 23 is offset with respect to the adjacent lateral free edge of the side end flaps 25 and 26 by a step-up 57. As a result, in the folded state, the front end flap 23 forms another, additional, outer, step-form compounded region with the edges 42,43,44, 45 of the gussets 37–40. A closing strip 58 which is applied to the outside of the pack and which consists of a foil provided with an adhesive coating or of a thermally bondable foil extends over the entire length of the face in the region of the step-form compounded areas, such that all the superposed layers are gripped and covered.

The closing strip 58 is provided with laterally overlapping ends 59 and 60 which are wrapped about the side walls 12 and 13 of the pack and affixed thereto. The one end, in this case the end 59 is provided with a non-adhesive gripping end 61 with which the closing strip 58 can be removed from the pack by gripping the same.

In the case of the invention the infra-red emitter 46 has a special configuration and disposition. The infra-red rays produced by an infra-red coil 62 are focussed by a parabolic reflector 63 and directed on the bonding or adhesive strip 36 to be activated. The spacing between the emitter 46 and the pack is selected in such a way that the entire bonding or adhesive strip 36 is activated. Accordingly, the distance is less than the focal width of the emitter.

Figure 17:
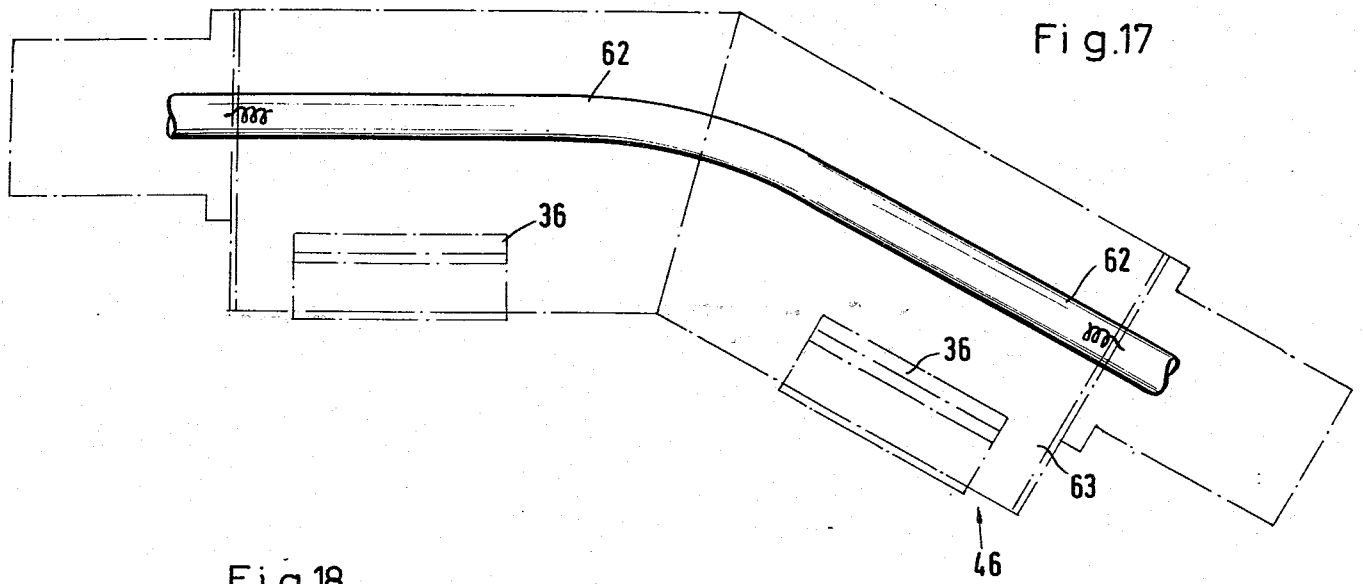
FIG. 17 is a diagrammatic plan view of an infra-red heating device for activating the surfaces of the pack closure which react to heat.

In FIG. 17, the infra-red emitter 46 extends with an appropriately constructed coil 62 over a plurality of stations of a device, more particularly, over two stations. As a result, the bonding or adhesive strip 36 is not only activated during a specific stage, namely during a working stroke, but also while the pack is being conveyed to the following station and also in this station. As the stations for receiving the packs are advantageously disposed on a round table or rotating device, the infra-red emitter is curved. The infra-red coil 62 is correspondingly curved such that in each position of the pack there is generally constant spacing between the coil 62 and the pack.

Figure 18:
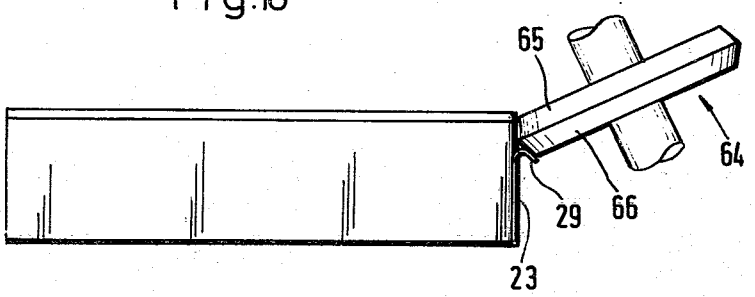
FIG. 18 is a detail view of a device for applying glue to the parts of the closure.

FIG. 18 shows a detail view of a device for applying glue to the surface regions of the pack to be connected together. This is designed for use in place of the thermal activation device. The device for applying glue to the surface regions consists of a profile wheel 64 which rests with two gluing surfaces 65 and 66, disposed at an angle with respect to each other, against the surfaces on which glue is to be applied, namely the underside of the connecting strip 29 of the front end flap 23 and against the step-form offset regions of the inner back end flap 24 and the gussets 37 and 38 and 39 and 40, and which transfer applied glue to these surfaces at a suitable point. In the case of these surfaces, the closure can be produced by means of a die 47 as described in reference to FIG. 16.

What is claimed is:

1. A pack for cigarettes or the like formed from a foldable blank of compound foil material wherein the blank has a front wall, a back wall, two side walls, front end flaps attached to the front wall, back end flaps attached to the back wall, and side end flaps attached to the side walls wherein the front, back and side walls are folded to enclose four sides of the contents, at least one of the front and rear end flaps are folded to contact the ends of the contents, the side end flaps are folded along generally diagonal fold lines to form generally triangular gussets, said gussets having longitudinal free edges which are staggered in a gradation of thickness with respect to each other and to the fold line of the flap folded against the contents and the remaining flap is folded over the entire end of the pack and the free edge is sealed across its entire width to hermetically seal the end of the pack.

2. A pack as claimed in claim 1, wherein the front end flap (23) springs back with respect to the layers of the side end flaps (25, 26) and wherein all the layers are covered and connected together by means of an outer closing strip (58), which is applied thereto.

3. A pack as claimed in claim 2 wherein the closing strip (58) which is applied to the pack as a closing element is in the form of a removable adhesive strip having ends (59,60) disposed laterally over the sides of the pack and which are affixed to the side walls (12,13).

4. A pack as claimed in claim 3 wherein the closing strip (58) is provided with a glue-free end (61).

5. A pack as claimed in claim 1 wherein the side end flaps (25,26) are folded inwards unsymmetrically with respect to an imaginary longitudinal center plane of the front face of the pack in such a way that the generally triangular gussets (37, 38;39, 40) are produced, which extend as far as a bonding or adhesive strip (36, 58).

6. A pack as claimed in claim 5, wherein the fold lines (30,31) for forming the generally triangular gussets (37,38;39,40) the free corner of the side end flaps (25,26), such that the folded gussets have parallel, offset edges (42,43;44,45).

7. A pack as claimed in claim 5, wherein the blank is formed from a compound foil having outer plastic layers and inner layers of paper and aluminum foil and the fold lines (30,31) are formed by perforating the inner layers while the outer plastic layers remain intact.

8. A pack as claimed in claim 1 wherein, step-like, staggered edges of the side end flaps are parallel to the fold line of the flap folded against the contents and to each other.

9. A pack as claimed in claim 8 wherein the back end flap (24) is separated from the adjacent side end flap on at least one side by a dividing cut (41) which is offset with respect to the fold line defining the adjoining longitudinal edge (17) of the pack in the region of the adjacent side end flap (26) over a part of the side flap (26) such that a corner connection (35) remains between the back end flap (24) and the side end flap (26) and such the inner gusset (40) of the side end flap

(26) is foldable with the edge (42) parallel to the fold (20) against the back end flap (24).

10. A pack as claimed in claim 8 wherein the back end flap (24) has an auxiliary fold line (33) running from the rear corner of the pack adjoining the side end flap (26), the auxiliary fold line (33) defining, with respect to the dividing cut (41), a section (34) which is adapted to be folded against the back end flap (24).

11. A pack as claimed in claim 1 wherein the side end flaps (26) are arranged so as to be folded in an offset arrangement (FIGS. 7-12) such that the longitudinal free edges (42, 44) are disposed in an offset manner having a gradation of thickness extending from the corner point.

12. A pack as claimed in claim 11 wherein the generally triangular gussets (39,40) of the side end flaps (26) and another triangular flap (56) formed by a fold line (55) in the back end flap (24) are formed by folding inwards the side end flaps (26) and are connected to the edges (42,44) facing towards the bonding or adhesive strip (37) and to the adjacent front and back end flaps (23,24).

13. A pack as claimed in claim 1, wherein the blank has an end strip (27) partially connected to one of the side end flaps outside of the region of the bonding and adhesive strip (36, 58), said end strip being folded inwards and covered by the successive side end flap (25).

14. A pack as claimed in claim 13, wherein the end strip has a diagonal fold line (28) and is connected to the adjoining side end flap (25) as far as a diagonal fold line (28).

15. A pack as claimed in claim 1 wherein the free edges (42-45) of the side end flaps (25,26) are offset with respect to the free edge of the front end flap (23) such that the latter forms an overlapping connecting strip (29) which is adapted to be connected to the end of the pack.

16. A pack as claimed in claim 11 wherein the regions of the pack to be connected together are provided with activatable, markings (48,49, 50, 51, 52,53).

17. A pack as claimed in claim 14 wherein the back end flap (24) is provided on the side facing toward the fold line (20) with an outer strip-form bonding mark (50) extending over the width of the flap, the side end flap (26) is provided with a bonding mark (51) which is disposed on the outside running along the free edge, and a counter mark is provided on the inner side along an outer edge and, if a dividing cut (41) is present, with a counter mark (53) in the region of the corner connection (35) on the inner side.

18. A pack as claimed in claim 1 wherein the front end flap (23) are activatable together with the remaining surface regions of the front side of the pack which are to be connected together.

* * * * *